US005443183A

United States Patent [19]

Jacobsen et al.

[11] Patent Number: 5,443,183

[45] Date of Patent: Aug. 22, 1995

[54] UNITARY CHECK VALVE

[76] Inventors: Kenneth H. Jacobsen, 921 N. Quentin Rd., Palatine, Ill. 60067; Louis F. Cole, 672 Constitution Dr., Unit 93-5, Palatine, Ill. 60074

[21] Appl. No.: 284,092

[22] Filed: Aug. 1, 1994

Related U.S. Application Data

[63] Continuation-in-part of Ser. No. 154,623, Nov. 18, 1993, abandoned.

[51] Int. Cl.[6] ..... B67D 5/60

[52] U.S. Cl. ..... 222/145.6; 222/494

[58] Field of Search ..... 222/137, 145, 213, 387, 222/485, 488, 494–497; 137/512.4, 512.5, 854, 855, 857

[56] References Cited

U.S. PATENT DOCUMENTS

| | | | |
|---|---|---|---|
| 2,826,339 | 3/1958 | Maillard | 222/387 |
| 2,876,935 | 3/1959 | Lindberg | 222/496 |
| 3,228,418 | 1/1966 | Rosbach et al. | 137/854 |
| 4,677,447 | 6/1987 | Nielsen | 137/854 |
| 4,753,536 | 6/1988 | Spehar et al. | 222/494 |
| 4,798,311 | 1/1989 | Workum | 222/496 |
| 5,263,614 | 11/1993 | Jacobsen et al. | 222/137 |
| 5,314,092 | 5/1994 | Jacobsen et al. | 222/137 |

*Primary Examiner*—Andres Kashnikow
*Assistant Examiner*—Philippe Derakshani
*Attorney, Agent, or Firm*—Charles F. Lind

[57] ABSTRACT

A check valve disposed to fit between paired outlet nozzles of adjacent cartridges of a multiple component reactive fluid system and a mixing tube sealed over the nozzles and having a single outlet for discharging the mixed reactive material. The check valve has a flat portion and an upstanding wall formed therefrom, each sized and shaped to seat over the nozzles and against the mixing tube. Openings formed in the flat portion commumicate with the nozzles and provide separate flow paths of the respective materials to the mixing tube. Check structure as separate flaps integral with the wall cover and close the openings. The internal flap resilience normally holds the check valve closed, but allows flap flexture to open the outlet nozzle when the cartridge pressures exceed the closing forces. The check valve restricts back flow of either material into either outlet nozzle.

9 Claims, 1 Drawing Sheet

UNITARY CHECK VALVE

RELATED APPLICATION

This is a continuation-in-part Application of our application filed Nov. 18, 1993 and having Ser. No. 08/154,623 now abandoned, and identified as CHECK VALVE.

BACKGROUND OF THE INVENTION

Caulk, adhesive, potting material and other fluid materials are commonly contained in tubular cartridges having an outlet nozzle at one end and an opposite open end that is closed by a wiper slidably seated against the inside face of the cartridge wall. The material is discharged from the outlet nozzle by advancing the wiper through the cartridge toward the nozzle, which increases the static pressure of the contained material sufficiently to overcome back pressures against such flow. Special mixing or routing conduits if connected to the outlet nozzle add to the outside back pressure. The force needed for moving the wiper depends on factors including the outside back pressure, the viscosity of the contained material, and the size of the cartridge.

Conventional dispensing tools utilize a plunger connected to a rod, and a power device activated by a control trigger forces the rod and plunger axially into the open cartridge end and against the wiper. Many dispensing tools are hand held and portable, being powered manually by a ratchet mechanism indexed incrementally upon each trigger squeeze or pneumatically by an air cylinder.

Our U.S. Pat. No. 5,263,614 issued on Nov. 23, 1993 discloses manual dispensing tools having spring linkages between the intermittently activated power ratchet device and incrementally advanced driven plunger, for storing and dissipating unused energy inputted to the device for maintaining substantially continuous forces on the plunger, even between successive trigger squeezes. This overcomes many problems associated with discharging an incompressible contained material by means of such a tool.

Our U.S. Pat. No. 5,314,092 issued on May 24, 1994 discloses a specific dispensing tool plunger having a shiftable O-ring for providing a sealing-venting action to minimize leakage past the wiper and plunger when pressurizing and discharging the contained material, while yet allowing the plunger to be removed from the emptied cartridge for reuse.

Single component materials set up primarily as each is discharged from its single cartridge. Multiple component reactive fluid material systems blend different components together in precise ratios to form an intended composite material, each separate component being stable alone but reacting to set up after being mixed together. The reaction or setting time will vary, but most commonly is short, as measured in minutes. Common multiple component reactive material systems include two-part epoxies, urethanes, silicones, phenolics, acrylics and polyesters.

Existing multiple component reactive material systems commonly use separate component cartridges held side-by-side, and interconnect the adjacent outlet nozzles via a common mixing tube having a single discharge outlet. The cartridges are commonly of equal length, and component cartridges of the same or different diameters would provide the specific needed component ratio. The advance of the plungers in unison through the cartridges would force the proportioned components together initially for blending in the mixing tube and discharge then from the tube outlet nozzle as the intended composite material.

Intermittent tool usage is common and the material volume used will vary during any particular Job. This means that material contained in the cartridge(s) and mixing tube/discharge conduit can begin to or do over time set up, making use of the remaining contained material questionable or impossible. Mixing tubes are accordingly made as throw-away items, intentionally sacrificing the material contained therein. Continued use or reuse of the material cartridge however is preferred, for realizing material cost savings to the users.

However, in most reactive material systems, the adjacent cartridge nozzles are interconnected via the inlet to the mixing tube, and one component can cross over via the mixing tube inlet and enter the cartridge of the other component, starting premature mixing of the components in the cartridge itself. That possibly is particularly enhanced as the cartridge nozzles are the same size and shape and the component pressures at the cartridge nozzles can instantaneously differ substantially during changing flow or discharge conditions; and considering that the viscosities of the separate components can differ substantially, such as having a pasty base component and a free-flowing liquid catalyst component, and that the volumetric ratio of base to catalyst component can vary widely, such as being 1:1, 3:1 or even 10:1.

This premature mixing can present a serious problem during intermittent tool usage, should a tool nonuse period exceed the reactive setting time and a glob of set material form in one cartridge and plug its outlet nozzle, making that cartridge unusable. Premature component mixing further could throw off the needed precise component mixing ratios, producing a different composite material no longer having the desired physical properties of the intended composite material. Disposal of partially emptied material cartridges because of premature setting can be quite costly for user of the material(s).

Our above-identified application Ser. No. 08/154,623 now abandoned discloses a check valve insert suited for use at the paired outlet nozzles of reactive component cartridges, the check valve having adjacent openings seated over the outlet nozzles and having a reed overlying and resiliently closing the openings except for when component pressures are being generated within the cartridges sufficient to cause intended discharge.

SUMMARY OF THE INVENTION

This invention relates to and a basic object of the invention is to provide a check valve insert to be used between paired adjacent cartridges of a multiple component reactive fluid material system, for minimizing unintended premature contact of the different components.

A more specific object of this invention is to provide an economical one-piece check valve for use between the outlet nozzles of the adjacent cartridges, effective for minimizing back flow of foreign material and/or one component into the cartridge of the other cartridge.

Related objects of this invention are to provide an improved one-piece check valve insert: that can be packaged with and carried on the paired reactive component cartridges, as they initially might be provided to the cartridge user; that can be easily removed by the cartridge user from the packaged cartridges; and that then can be positioned in a foolproof manner by the user operatively in place over the adjacent paired cartridge outlet nozzles, effective for minimizing problems of premature mixing and setting of the contained cartridge components within either cartridge.

BRIEF DISCRIPTION OF THE DRAWINGS

These and further objects, advantages and features of the present invention will be understood and appreciated upon reviewing the following disclosure, including as a part thereof the accompanying drawings, in which.

Figure 1:
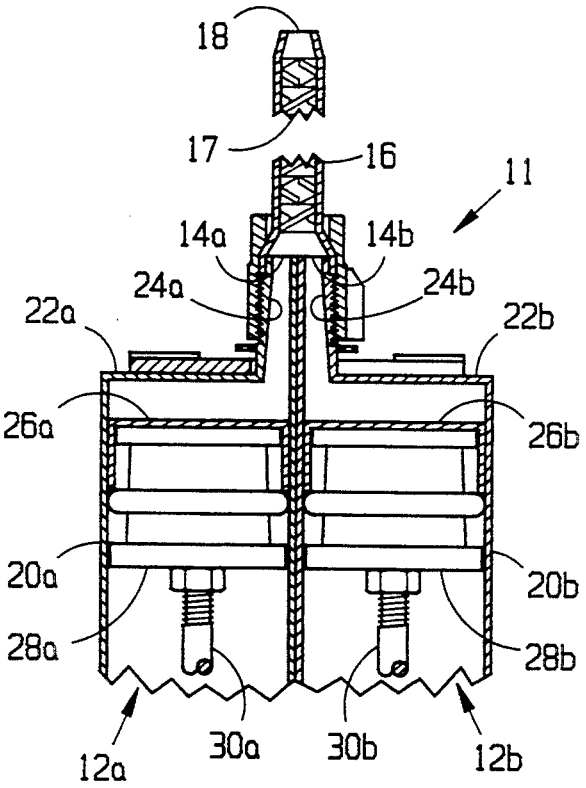
FIG. 1 is an elevational center sectional view of adjacent paired component cartridges of a multiple component reactive material system, with a mixing tube connected off of the cartridge outlet nozzles.
Figure 4A:
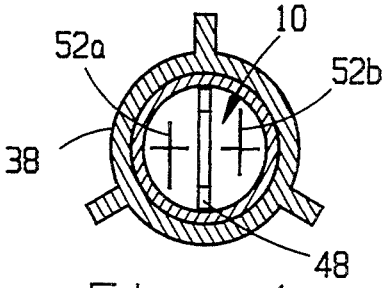
Figure 4B:
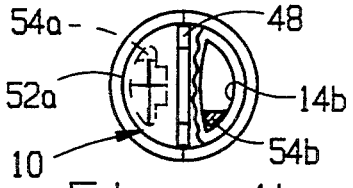
Figure 4C:
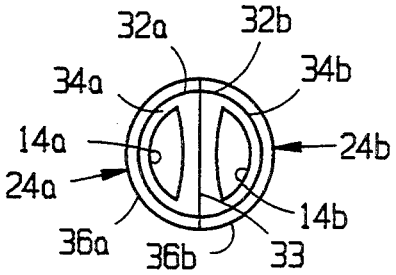
Figure 2:
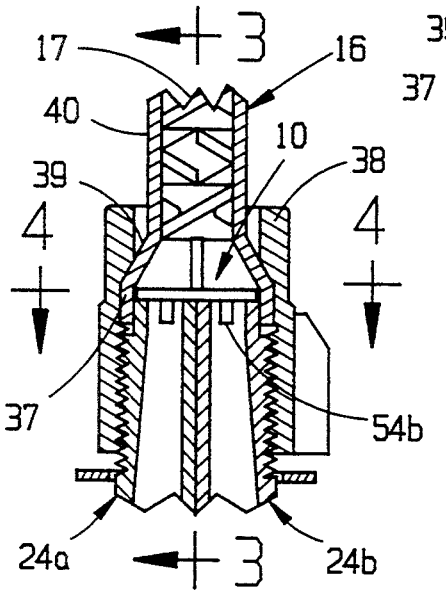
FIG. 2 is an enlarged view of part of FIG. 1, showing the check valve of this invention operatively in place relative to the cartridges and mixing tube.
Figure 3:
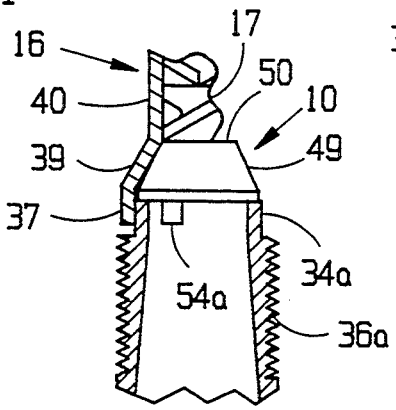
FIG. 3 is a sectional view as seen generally from lines 3—3 of FIG. 2, with some of the structures broken away or not shown, for clarity of disclosure.
Figure 6:
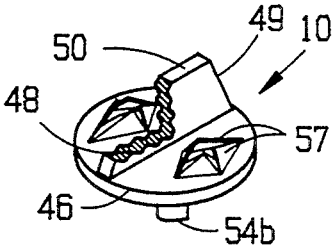
Figure 5:
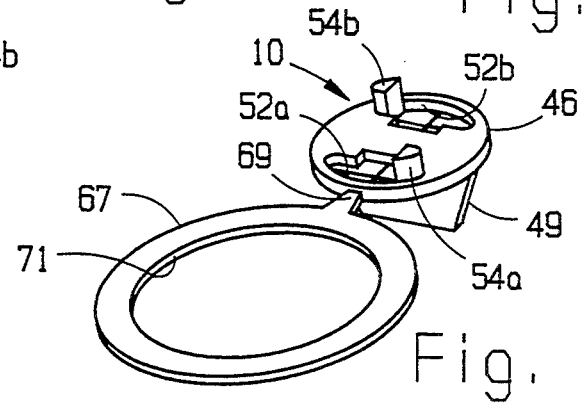

FIGS. 4*a*, 4*b* and 4*c* are sectional views, as seen generally from lines 4—4 in FIG. 2, with some of the structures progressively broken away or not shown in moving in the direction of the section arrows from FIG. 4*a* to FIG. 4*c*, for clarity of disclosure;

FIG. 5 is a perspective view from the underside of the whole check valve, as it is originally formed; and FIG. 6 is a perspective view from the upper side of the check valve, illustrated flexed in a material-passing simulated condition.

DETAILED DESCRIPTION OF A PREFERRED EMBODIMENT

The check valve 10 is illustrated in a multiple component reactive material system 11 comprised of two separate adjacent component cartridges 12*a*, 12*b* having adjacent paired outlets 14*a*, 14*b* that open to a single mixing tube 16. The conventional mixing tube 16 would have a helical screw-like insert 17 that defines intertwined axially extended flow passages (not shown) that separate and combine repeatedly. This provides for throughly blending the axially flowing components together before being discharged as a different composite material from tube outlet 18.

In most reactive material systems, the cartridges 12*a*, 12*b* are separate and releasibly held together in parallel side-by-side relationship by cooperating structures (not shown) formed in the adjacent cartridge walls. Each cartridge 12*a*, 12*b* has a tubular body wall 20*a*, 20*b* with the front end closed by wall 22*a*, 22*b* having nozzle 24*a*, 24*b*, and with an open rear end. A wiper 26*a*, 26*b* closes the open rear end of each cartridge and slides along the inside face of the cartridge, for forcing the material out of the cartridge outlet. Plungers 28*a*, 28*b* supported on rods 30*a*, 30*b* are moved under power axially within the cartridges and against the wipers, to generate the component pressures needed for overcoming back pressures resisting such flow.

The illustrated nozzles 24*a*, 24*b* are in the form of matched equi-sized half-cylinders 32*a*, 32*b* having adjacent flat walls 33 and concentrically non-threaded nose portions 34*a*, 34*b* and threaded portions 36*a*, 36*b*, that respectively line up adjacent one another to define a single threaded cylindrical nose centered approximately along the tangentially contacting cartridge side walls 20*a*, 20*b*. The static mixing nozzle tube 16 has a cylindrical wall 37 sized to seat snuggly over the defined single nose portion. An annular nut 38 fitted over the tube is threaded onto the threaded nose to retain the static mixing tube sealed over the cartridge outlets 14*a*, 14*b*. The mixing tube further has conical wall 39 extended between the cylindrical wall 37 and generally cylindrical main wall 40, that extends generally to the outlet 18.

The paired outlets 14*a*, 14*b* of the illustrated cartridges are disposed side-by-side and terminate along a common plane at a generally flat nose end. The outlets are similarly sized and shaped (see FIG. 4*c*) regardless of the cartridge's volume or the material's viscosity, each with a semicircular concave outer edge and a curved concave inner edge, the edges meeting at two opposed corners.

The illustrated check valve 10 fits against the generally flat nose end defined by the cartridges, and is held in place by the overlying mixing tube. To provide for this, the check valve 10 has a flat base wall 46 sized generally the same as the defined end nose, and has an upstanding wall 48 with side edges 49 tapered the same as the conical wall 39 of the mixing tube 16 operable to seat generally flush thereagainst as the mixing tube 16 is tightened down by the nut 38.

The base wall 46 has two openings 52*a*, 52*b* spaced apart to correspond to the cartridge nozzle outlets 14*a*, 14*b*, and the upstanding wall 48 is positioned to cross between the openings. With the base wall properly positioned against the cartridge nose end, the openings 52*a*, 52*b* overlie the cartridge nozzle outlets 14*a*, 14*b* and form the only paths for material flow between the cartridges and mixing tube.

When the valve piece is so positioned, the upstanding wall 48 crosses the mixing tube inlet cavity between the cartridge nozzle outlets 14*a*, 14*b*, and forms a barrier other than over top edge 50 for the material from one cartridge to get to the nozzle outlet of the other cartridge. The top edge 50 of the upstanding wall 48 is generally at or only slightly below the transition between the conical and main walls 39 and 40 respectively, and is reasonably close to but could be spaced from the blending insert 17 inside the tubular wall 40.

Small pins 54*a*, 54*b* project from the underside of the flat wall 46, each being adjacent an end of its adjacent opening, adapted to fit into the nozzle outlets for orienting the check valve properly on the nozzles.

A preferred pin arrangement would locate only two pins 180 degrees opposite one another, such as at the 5:00 and 11:00 o'clock points when viewed from the upper side of the base wall (FIG. 4*b*), with the upstanding wall 48 lying along the 12:00–6:00 o'clock plane. The pins would be at equal radii from the center of the base wall, Just less than the semicircular concave outer edges of the nozzle outlets. Regardless of how the check valve 10 might be oriented when the base wall is positioned against the flat cartridge nose end with the pins fitted in the nozzle outlets, it would then be rotated to the proper position with the the nut as it is rotated onto the cartridge threads, being stopped when the pins butt the inner edges of the nozzle outlets at the lead corners relative to the tightening direction of nut rotation.

Check closure flaps 57 extend across the flat wall openings 52*a*, 52*b*, being integrally cantilevered from the wall 46 at the outboard regions of each opening. The flaps 57 are configurated as segments separated from one another along closely proximate radial inboard edges meeting at the approximate opening center.

The flaps are illustrated thinner than the wall thickness to be flexible, to allow lateral flap shifting between normally closed positions aligned with the base wall and opened positions angled from the base wall (see FIG. 6).

The need for the check valve 10 can be appreciated when the cartridge components have vastly different flow characteristics, and one component could gain and/or lose its instantaneous contained pressure at the nozzle outlets 14*a*, 14*b*, compared to the other component, even with unified plunger movements through the cartridges. This might occur when beginning or ending component discharges, or during the normal pulsed power device actuation, vis each trigger squeeze. However, with the check valve in place, the flaps 57 would be flexed open when component pressures sufficiently exceed the mixing tube inlet cavity pressure and valve closing resilience, to allow component discharge into the inlet cavity, and would resiliently close upon either cartridge pressure being reduced to near normal. This action would thereby preclude or minimize back flow of either material into the other cartridge and its possible contamination.

The check valve can be molded as a single piece from a durable plastic, providing sufficient strength, resiliency and shape memory, to allow flap flexture from and return then to the closed positions. Of additional interest, a ring 67 can simultaneously be formed aligned with and off of the base wall 46, connected at weakened neck 69, the ring having an inside opening 71 sized to fit over the adjacent paired cartridge half-cylinders 32*a*, 32*b*. This would allow the vendor of the component cartridges, typically packaged side-by-side in paired cartridge combinations needed for particular composite materials, to position the check valve ring 67 over the adjacent paired half-cylinders 32*a*, 32*b* and thereby vend the check valve 10 as part of the component cartridge package.

A cartridge user, when thereafter assemblying the paired cartridges in a dispensing tool, could easily break the check valve 10 free of the ring 67 and position it in place over the adjacent paired cartridge outlet nozzles, and without removing the ring 67 from the paired cartridges. Also, the check valve will automatically become properly oriented on the paired cartridge outlet nozzles merely by putting the pins 54*a*, 54*b* in the outlet nozzles, as the mixing tube positioned over the check valve will be rotated slightly as the nut 38 is rotated and tightened onto the paired cartridges, and the shifting mixing tube will rotate the underlying check valve until the pins butt against the inner outlet nozzle edges.

The upstanding wall 48 having its side edges 49 seated against the mixing tube conical wall 39 and crossing between the two openings 52*a*, 52*b* and the underlying nozzle outlets 14*a*, 14*b*, precludes direct component passage between the nozzle outlets, but instead forces any flow over or around the top wall edge 50.

While only a specific embodiment of the invention has been illustrated, it is apparent that variations may be made therefrom without departing from the inventive concept. Accordingly, the invention is to be limited only by the scope of the following claims.

What we claim as our invention is:

1. For use in a multiple component reactive fluid system having separate material cartridges with respectively separate adjacent paired outlet nozzles, and a mixing tube having inlet structure sealed over the paired-nozzles and communicating via an interconnecting cavity with mixing structure and a single outlet downstream therefrom, to provide for composite reactive material discharge from said single outlet, a unitary piece check valve comprising a generally flat base wall having openings spaced apart to correspond to the paired outlet nozzles, a partition wall upstanding from the base wall and crossing between the spaced openings, and flexible check structures cantilevered from the perimeter of each opening to overlie and normally close the opening;

said flat base wall being adapted to seat over the paired outlet nozzles with the spaced openings communicating respectively therewith, and the partition wall being adapted to seat against the mixing tube inlet structure and divide the interconnecting cavity into two portions respectively communicating with the outlet nozzles and to baffle the outlet nozzles from one another other than via over the partition wall, and said check structures having shape memory effective to open only when the pressure in the material cartridge exceed the normal closing forces for allowing material flow therepast and through the mixing tube while yet restricting back flow of either material into either outlet nozzle.

2. A check valve according to claim 1, further comprising said check structures being defined by separate flaps having closely adjacent substantially butting inboard edges, the flaps thereby overlying and closing the openings.

3. A check valve according to claim 2, further comprising said flaps having outboard regions integral with the base wall and generating resilient forces normally holding the flaps in the closed positions.

4. A check valve according to claim 1, further comprising a ring aligned with and integral with the base wall connected across a weakened neck, the ring having an inside opening sized to fit over the adjacent paired cartridges defining the outlet nozzles, providing the check valve can be used with the cartridges as by merely breaking it from the ring.

5. A check valve according to claim 1, further comprising the base wall having a first face adapted to seat against the cartridges with the openings over the adjacent outlet nozzles, said partition wall upstanding from a second face of the base wall opposite the first face, and said openings being formed in the base wall extended between the first and second faces.

6. A check valve according to claim 5, further comprising said check structure flaps being defined as generally pie-shaped segments separated from one another along radial edges and being integral at outboard regions with the base wall, and the flaps being resilient and having shape memory to normally overlie and close the openings.

7. A check valve according to claim 6, further comprising the base wall having a pin projecting from the first face adjacent each respective opening, suited to be fitted one each into each respective adjacent outlet nozzle, to orient the check valve in place with the openings communicating with respective adjacent outlet nozzles and the partition wall crossing the mixing tube inlet cavity between the cartridge nozzle outlets.

8. A check valve according to claim 7, further comprising each pin being located at radial spacings from the center of the check valve base wall, suited with the generally snug fit of the base wall within the overlying mixing tube to track within the cartridge nozzle outlet until being stopped at a proper downstream edge, reference to the rotation of a nut for holding the mixing tube on the cartridges.

9. A check valve according to claim 8, further comprising a ring aligned with and integral with the base wall connected across a weakened neck, the ring having an inside opening sized to fit over the adjacent paired cartridges defining the outlet nozzles, providing the check valve can be used with the cartridges as by merely breaking it from the ring.

* * * * *